US008177069B2

(12) United States Patent
Valerio

(10) Patent No.: US 8,177,069 B2
(45) Date of Patent: May 15, 2012

(54) SYSTEM AND METHOD FOR SORTING DISSIMILAR MATERIALS

(75) Inventor: Thomas A. Valerio, Stone Mountain, GA (US)

(73) Assignee: Thomas A. Valerio, New Port Richey, FL (US)

( * ) Notice: Subject to any disclaimer, the term of this patent is extended or adjusted under 35 U.S.C. 154(b) by 248 days.

(21) Appl. No.: 12/006,932

(22) Filed: Jan. 7, 2008

(65) Prior Publication Data

US 2008/0257793 A1 Oct. 23, 2008

Related U.S. Application Data

(60) Provisional application No. 60/878,856, filed on Jan. 5, 2007.

(51) Int. Cl.
*B07C 5/34* (2006.01)
*B03B 1/02* (2006.01)

(52) U.S. Cl. ..... 209/11; 209/576

(58) Field of Classification Search ..... 209/11, 209/576, 577, 44.2, 639, 644, 939, 4
See application file for complete search history.

(56) References Cited

U.S. PATENT DOCUMENTS

| | | | |
|---|---|---|---|
| 2,587,686 | A | 3/1952 | Robert |
| 3,448,778 | A | 6/1969 | Ramsay |
| 3,490,702 | A | 1/1970 | Dore |
| 3,568,839 | A | 3/1971 | Dunlea |
| 3,588,686 | A | 6/1971 | Lingmann et al. |
| 3,670,969 | A | 6/1972 | Terada |
| 3,701,419 | A | 10/1972 | Hutter et al. |
| 3,702,133 | A | 11/1972 | Vibert et al. |
| 3,702,682 | A | 11/1972 | Williams |
| 3,905,556 | A | 9/1975 | Drage |
| 3,975,263 | A | 8/1976 | Elo |
| 4,317,521 | A | 3/1982 | Clark |
| 4,362,276 | A | 12/1982 | Morey |
| 4,387,019 | A | 6/1983 | Dale |
| 4,405,451 | A | 9/1983 | Roman |

(Continued)

FOREIGN PATENT DOCUMENTS

| | | |
|---|---|---|
| DE | 4306781 | 9/1994 |

(Continued)

OTHER PUBLICATIONS

Hottenstein. Beyond Density. Recycling Today [online]. Nov. 18, 2008, http://www.recyclingtoday.com/Article.aspx?article_id=21468.

(Continued)

*Primary Examiner* — Joseph C Rodriguez
(74) *Attorney, Agent, or Firm* — King & Spalding

(57) ABSTRACT

Sorting dissimilar materials, such as sorting plastics from wood, foam, or rubber. These systems and methods employ either dielectric heating or fluorescent dye absorption characteristics of materials to distinguish the materials. The systems and methods may employ differential dielectric heating and thermal imaging to sort wood, rubber, and foam, from plastic, metals, and other materials that do not undergo dielectric heating. Similarly, systems and methods may employ the greater liquid absorption properties of wood, rubber, and foam as compared to plastic. The dissimilar materials are subjected to fluorescent dye and carrier liquid, that is differentially absorbed by objects. Fluorescent imaging can be used to distinguish the materials. In either case, a computer-controlled system can be used to sort material types based on an evaluation of the thermal or fluorescent image.

11 Claims, 6 Drawing Sheets

U.S. PATENT DOCUMENTS 4,541,530 A 9/1985 Kenny et al.
4,557,386 A 12/1985 Buckley et al.
4,563,644 A 1/1986 Lenander et al.
4,576,286 A 3/1986 Buckley et al.
4,597,487 A 7/1986 Crosby
4,718,559 A 1/1988 Kenny et al.
4,724,384 A 2/1988 Castovilly et al.
4,848,590 A 7/1989 Kelly
4,851,110 A 7/1989 Rolle et al.
4,933,075 A * 6/1990 Nordin et al. ..... 209/576
4,940,187 A 7/1990 Lee
4,986,410 A 1/1991 Shield
5,000,390 A 3/1991 Marrs
5,022,985 A 6/1991 Nugent
5,025,929 A 6/1991 Carrera
5,139,150 A 8/1992 Fuller
5,148,993 A 9/1992 Kashiwagi
5,169,073 A 12/1992 Marabini
5,209,355 A 5/1993 Mindermann
5,260,576 A 11/1993 Sommer
5,273,166 A 12/1993 Sawamura
5,314,071 A 5/1994 Christian
5,314,072 A 5/1994 Frankel
5,335,791 A 8/1994 Eason
5,341,935 A 8/1994 Djerf et al.
5,344,025 A 9/1994 Tyler et al.
5,344,026 A 9/1994 Booth et al.
5,361,909 A 11/1994 Gemmer
5,413,222 A 5/1995 Holder
5,433,157 A 7/1995 Dittmann et al.
5,443,157 A 8/1995 Baker et al.
5,465,847 A 11/1995 Gilmore
5,468,291 A 11/1995 Waterson et al.
5,502,559 A 3/1996 Powell et al.
5,512,758 A 4/1996 Kobayashi et al.
5,535,891 A 7/1996 Kuniyone
5,548,214 A 8/1996 Yasohama
5,555,324 A 9/1996 Waxman et al.
5,555,984 A 9/1996 Sommer
5,562,743 A 10/1996 Daugherty
5,611,493 A 3/1997 Hayashi et al.
5,624,525 A 4/1997 Ehara
5,628,409 A * 5/1997 Thomas ..... 209/577
5,632,381 A 5/1997 Thust et al.
5,667,151 A 9/1997 Miura et al.
5,678,775 A 10/1997 Chapman
5,739,524 A 4/1998 Fally
5,791,489 A 8/1998 Leifeld
5,801,530 A 9/1998 Crosby
5,829,600 A 11/1998 Jordan et al.
5,829,694 A 11/1998 Chapman
6,100,488 A 8/2000 Satake et al.
6,112,903 A 9/2000 Kimmel
6,124,560 A 9/2000 Roos
6,144,004 A 11/2000 Doak
6,191,580 B1 2/2001 Guichard
6,199,779 B1 3/2001 Mosher
6,313,422 B1 11/2001 Anibas
6,319,389 B1 11/2001 Fountain et al.
6,420,866 B1 7/2002 Goldberg et al.
6,452,396 B2 9/2002 Ott
6,497,324 B1 12/2002 Doak
6,568,612 B1 5/2003 Aoki
6,669,839 B2 12/2003 Tipton et al.
6,696,655 B2 2/2004 Harbeck et al.
6,838,886 B2 1/2005 Hilliard
6,914,678 B1 7/2005 Ulrichsen et al.
6,984,767 B2 1/2006 Hunt
7,173,411 B1 2/2007 Pond
7,296,340 B2 11/2007 Sakaida et al.
7,351,376 B1 4/2008 Quake et al.
7,351,929 B2 4/2008 Afsari et al.
7,354,733 B2 4/2008 Bukshpan et al.
7,449,655 B2 * 11/2008 Cowling et al. ..... 209/577
7,674,994 B1 3/2010 Valerio
7,786,401 B2 8/2010 Valerio
2001/0045378 A1 11/2001 Charles et al.
2002/0074274 A1 6/2002 Peggs
2003/0052684 A1 3/2003 Nelson et al.
2004/0144693 A1 7/2004 Tse
2005/0242006 A1 11/2005 Bohlig
2006/0037889 A1 2/2006 Fitch
2006/0219276 A1 10/2006 Bohnert
2007/0045158 A1 * 3/2007 Johnson ..... 209/11
2007/0084757 A1 4/2007 Jeon et al.
2007/0098625 A1 5/2007 Adams
2007/0187299 A1 8/2007 Valerio
2007/0187305 A1 8/2007 Valerio
2007/0262000 A1 11/2007 Valerio
2008/0257794 A1 * 10/2008 Valerio ..... 209/567
2009/0250384 A1 10/2009 Valerio
2010/0005926 A1 1/2010 Valerio

FOREIGN PATENT DOCUMENTS

EP 0332564 9/1989
EP 0541403 5/1993
SU 1039567 9/1983
SU 1606208 11/1990
WO WO 2006/131377 12/2006
WO 2009067570 5/2009
WO WO 2004/0657570 5/2009

OTHER PUBLICATIONS

Goosey et al. A Scoping Study: End-of-Life Printed Circuit Boards [online]. 2002, http://cfsd.org.uk/seeba/TD/reports/PCB_Study.pdf.

* cited by examiner

300

SYSTEM AND METHOD FOR SORTING DISSIMILAR MATERIALS

RELATED APPLICATIONS

The patent application claims priority under 35 U.S.C. §119 to U.S. Provisional Patent Application No. 60/878,856, entitled Method and Apparatus for Sorting Dissimilar Materials, filed Jan. 5, 2007, the complete disclosure of which is hereby fully incorporated herein by reference.

FIELD OF THE INVENTION

This invention relates to systems and methods for sorting dissimilar materials. More particularly, this invention relates to systems and methods for employing electromagnetic radiation and imaging systems to distinguish between dissimilar materials.

BACKGROUND OF THE INVENTION

Recycling of waste materials is highly desirable from many viewpoints, not the least of which are financial and ecological. Properly sorted recyclable materials can often be sold for significant revenue. Many of the more valuable recyclable materials do not biodegrade within a short period, and so their recycling significantly reduces the strain on local landfills and ultimately the environment.

Typically, waste streams are composed of a variety of types of waste materials. One such waste stream is generated from the recovery and recycling of automobiles or other large machinery and appliances. Other waste streams may include electronic components, building components, or other industrial waste streams. These materials are generally of value only when they have been separated into like-type materials. However, in many instances, no cost-effective methods are available to effectively sort waste streams that contain diverse materials. This deficiency has been particularly true for non-ferrous materials, and particularly for non-metallic materials, such as high density plastics, and non-ferrous metals, including copper wiring. For example, one approach to recycling plastics has been to station a number of laborers along a sorting line, each of whom manually sorts through shredded waste and manually selects the desired recyclables from the sorting line. This approach is not sustainable in most economics since the labor cost component is too high. Also, while ferrous recycling has been automated for some time, mainly through the use of magnets, this technique plainly is ineffective for sorting non-ferrous materials. Again, labor-intensive manual processing has been employed to recover wiring and other non-ferrous metal materials. Because of the cost of labor, many of these manual processes are conducted in other countries and transporting the materials to and from these countries adds to the cost.

A variety of plastics may be contained within a waste stream. Some such plastics include polypropylene (PP); polyethylene (PE); acrylonitrile butadiene styrene (ABS); polystyrene (PS), including high impact polystyrene (HIPS), and polyvinyl chloride (PVC). Other materials, such as wood, rubber, and foam may be present. Typically, these materials are less valuable, and ultimately make up the waste materials from the recovery process. Of course, in some cases, these materials may be recovered as useful depending on the application.

Many processes for identifying and separating materials are know in the art. However, not all processes are efficient for recovering plastics and non-ferrous metals and the sequencing of these processes is one factor in developing a cost-effective recovery process.

Some materials absorb electromagnetic energy, such as microwave or radio wave energy, in a process called dielectric heating. Some molecules are electric dipoles, meaning that they have a positive charge at one end and a negative charge at the other. The most common dipole molecule is water. When exposed to microwaves or radio waves these dipoles rotate as they try to align themselves with the alternating electric field induced by the microwave or radio wave beam. This molecular movement creates heat as the rotating molecules hit other molecules and put them into motion. For example, materials that tend to heat when exposed to microwaves include wood, rubber and foam. In contrast, other materials such as plastics are not heated when exposed to microwave radiation.

Fluorescent dyes have been used as tracers, such as to detect liquid leaks or identify the location of an object (the military uses fluorescent dyes to mark the location of a downed airplane in a body of water). When exposed to ultraviolet (UV) light or light of other wavelengths, these dyes fluoresce, indicating the presence of the dye. As such, porous materials could absorb dye-bearing liquid and UV light could be used to detect the presence of this liquid in the pores of the material. Wood, rubber, and foam would be examples of porous materials, while plastics and metals would typically not be porous.

In view of the foregoing, a need exists for cost-effective, efficient methods and systems for sorting materials, such as materials seen in a recycling process, including plastics and metals, in a manner that facilitates revenue recovery while also reducing landfill. Such methods and systems may employ electromagnetic radiation or fluorescent dyes to distinguish the plastics and metals from other materials, such as wood, rubber, and foam.

SUMMARY OF THE INVENTION

The present invention provides systems and methods for employing electromagnetic radiation and imaging systems to distinguish between dissimilar materials. In one aspect of the invention, a system for sorting objects is provided. The system includes an electromagnetic radiation source; a thermal imaging camera, able to capture a thermal image of objects irradiated with the electromagnetic radiation source; a computer, connected to the thermal imaging camera and able to evaluate the thermal image captured by the thermal imaging camera; and a sorter, connected to the computer and able to divert one or more of the objects.

In another aspect of the invention, a system for sorting objects is provided. The system includes a sprayer, able to apply a liquid, which includes a carrier liquid and a dye, on objects; a light source, able to illuminate the objects, where the dye fluoresces when illuminated by the light source; an imaging camera, able to capture a fluorescent image of the objects that fluoresce when illuminated by the light source; a computer, connected to the imaging camera and able to evaluate the image captured by the imaging camera; and a sorter, connected to the computer and able to divert one or more of the objects.

In yet another aspect of the invention, a method for sorting materials is provided. The method includes the steps of a) placing objects on a conveyor; b) irradiating the objects with electromagnetic radiation, where a portion of the objects increase in temperature in response to the irradiation; c) capturing a thermal image of the irradiated objects; d) evaluating the thermal image; and e) triggering a sorter in response to the evaluation to divert one or more of the objects.

In yet another aspect of the invention, a method for sorting materials is provided. The method includes the steps of a) illuminating objects with a light source, where a portion of the objects include a dye that fluoresces when illuminated by the light source; b) capturing a fluorescent image of the objects; c) evaluating the fluorescent image; and d) triggering a sorter in response to the evaluation to divert one or more of the objects.

DETAILED DESCRIPTION OF THE EXEMPLARY EMBODIMENTS

Exemplary embodiments of the present invention provide systems and methods for sorting dissimilar materials, such as sorting plastics from wood, foam, or rubber. These systems and methods employ either dielectric heating or fluorescent dye absorption characteristics of materials to distinguish the materials. The systems and methods may employ differential dielectric heating and thermal imaging to sort wood, rubber, and foam, from plastic, metals, and other materials that do not undergo dielectric heating. Similarly, systems and methods may employ the greater liquid absorption properties of wood, rubber, and foam as compared to plastic. The dissimilar materials are subjected to fluorescent dye and carrier liquid, that is differentially absorbed by objects. Fluorescent imaging can be used to distinguish the materials. In either case, a computer-controlled system can be used to sort material types based on an evaluation of the thermal or fluorescent image.

Figure 1:
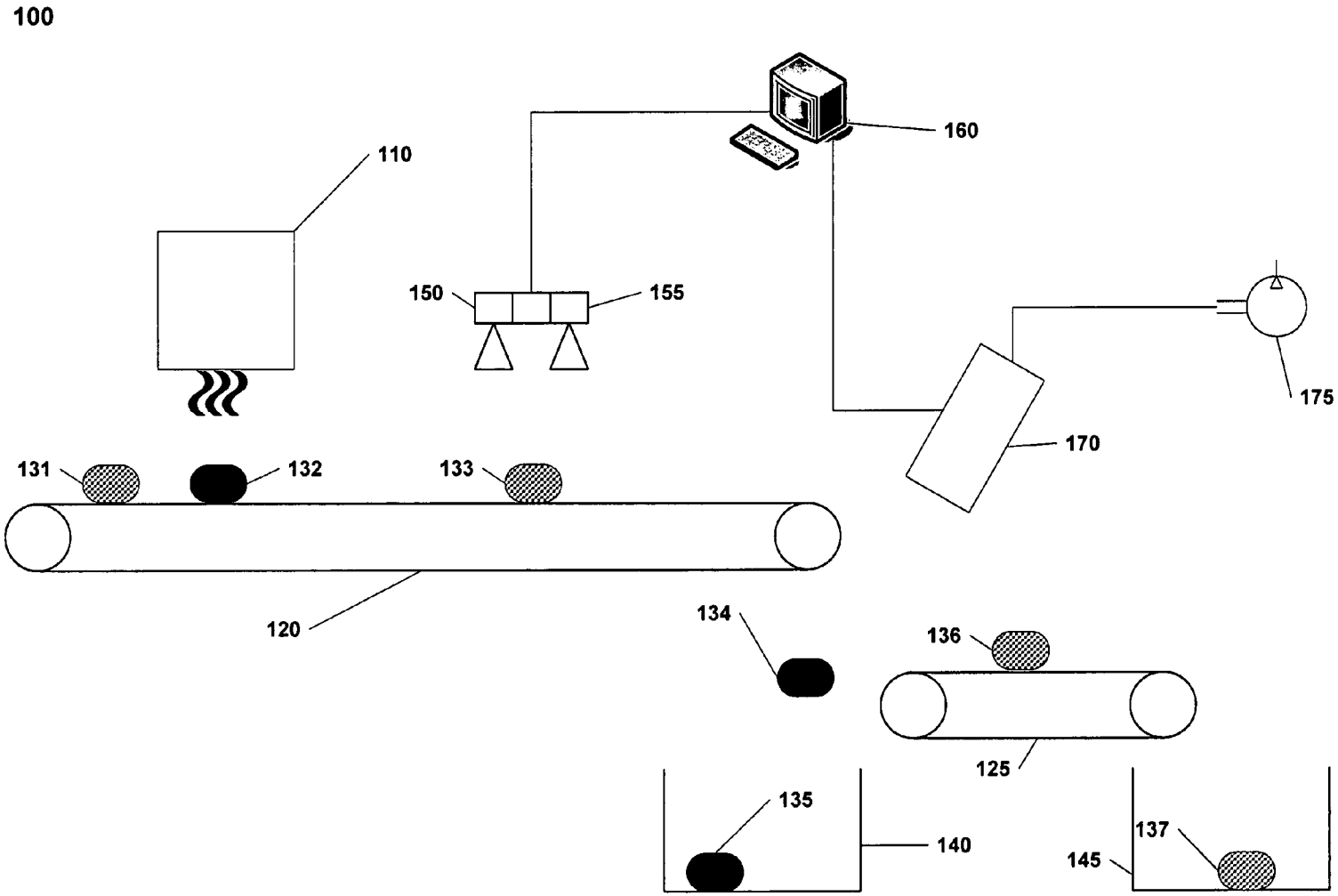
FIG. 1 depicts an electromagnetic energy sorting system in accordance with an exemplary embodiment of the present invention.

FIG. 1 depicts an electromagnetic energy sorting system 100 in accordance with an exemplary embodiment of the present invention. Referring to FIG. 1, an electromagnetic radiation source, such as a microwave source 110, irradiates material on a conveyance system. A conveyer belt 120 receives materials to be sorted, such as objects 131, 132, 133.

Microwaves are electromagnetic waves that have a frequency of about 2450 MHz and a wavelength of about 12.24 cm. The microwave source 110 may be either a solid state device or a vacuum-tube based device. Microwaves can be generated using integrated circuits, which are often called MMIC (Monolithic Microwave Integrated Circuits). They are usually manufactured using gallium arsenide (GaAs) wafers, though silicon germanium (SiGe) and heavy-dope silicon are increasingly used. Solid state microwave devices are based on semiconductors include field effect transistors (FETs), bipolar junction transistors (BJTs), Gunn diodes, and IMPATT diodes. Specialized versions of standard transistors have been developed for higher speed, which are commonly used in microwave applications. Microwave variations of BJTs include heterojunction bipolar transistors (HBT), and microwave variants of FETs include MESFET, HEMT, and LDMOS transistors. In contrast to solid state devices, vacuum tube devices operate on the ballistic motion of electrons in a vacuum under the influence of controlling electric or magnetic fields, and include the magnetron, klystron, traveling wave tube (TWT), and gyrotron. These vacuum devices work in the density modulated mode, rather than the current modulated mode. The depth of penetration of microwaves in an object is dependent upon the object's composition and the microwave frequency. Lower microwave frequencies penetrate deeper into the materials. In this exemplary embodiment, the materials to be sorted are irradiated with microwave radiation such that materials comprising dipole molecules increase in temperature, with this increase proportional to the amount of dipole molecules present in the material and the ability of the microwave to penetrate the materials.

Other electromagnetic radiation, such as radio waves, can be used to heat objects containing dipole molecules.

The materials to be sorted, such as objects 131, 132, 133, may be shredder residue from shredding automobiles, large consumer appliances, electronics, or other waste material. This shredder residue may be pre-processed to remove specific types of materials. Also, before the material is sent to the conveyance system, such as conveyer belt 120, the material may be reduced in size.

An additional pre-processing step may include stabilizing the moisture content of the material before it is sent to the conveyance system. First, the material is subjected to a humidifier or mister. The humidifier or mister exposes the material to moisture. So, wood and other porous materials would absorb the water. Then, the material is subjected to a dryer, such as a fluidized bed drier. This drying process will remove the moisture from the surface of the non-porous materials, such as plastic, but not from the porous materials, such as wood. As such, the non-plastic materials would have a greater water content and experience greater dielectric heating when subjected to the microwave irradiation. Although this pre-processing step may have some benefit to the overall process, especially if the porous materials are extremely dry, this step is not necessary.

For illustration purposes, FIG. 1 depicts the materials to be sorted with two patterns. For example, the object 131 is depicted with a cross-hatch pattern and represents wood, foam, or rubber. Object 132 is depicted with a solid black pattern and represents plastic. These depictions are for illustration purposes and are not meant to indicate that the materials are sorted based on their color or appearance.

The conveyance system of this exemplary embodiment includes two conveyers, conveyer belt 120 and conveyer belt 125. Conveyer belt 120 receives the materials to be sorted and passes the materials under the microwave source 110 and a thermal imaging camera 150 and an optical camera 155. In this exemplary embodiment, the conveyer belt 120 preferably moves continuously. In an alternative embodiment, the conveyer belt 120 may move such that the materials move in a batch-wise manner, such as first stopping under the microwave source 110 and then stopping under the thermal imaging camera 150 and the optical camera 155. Some material is transferred to the conveyer belt 125 and transported to a box 145. Other materials are sorted to a box 140. The operation of the thermal imaging camera 150 and the optical camera 155 and the subsequent sorting process are discussed below.

After the microwave source 110 irradiates the materials to be sorted, the materials continue to the thermal imaging camera 150 and the optical camera 155. The thermal imaging camera 150 captures a thermal image of the material. A thermal imaging camera detects infrared radiation in a manner similar to how an optical camera detects visible light to create an image. In the case of the thermal imaging camera, the resulting image shows the varying intensity of infrared radiation emanating from the objects whose image the camera captures. Infrared radiation is given off by objects radiating heat. The warmer the object, the more infrared radiation emanating from that object. A resulting thermal image depicts the varying level of heat emanating from the object. Typically, the warmer the object, the brighter the image of that object is. Any one of a large variety of commercially-available thermal imaging systems can be employed in the system 100.

The optical camera 155 works in conjunction with the thermal imaging camera 150 to capture an image of objects being assessed by the thermal imaging camera 150. The image from the optical camera 155 would be similar to the image taken from a normal camera, which is based on capturing visible light. The image from the optical camera 155 can be used to support the sorting process, as described below.

The captured thermal image is processed by a computer 160. The computer 160 includes software that can interpret the thermal image captured by the thermal imaging camera 150 and distinguish objects based on the image. Thermal imaging systems can detect differences in temperature of just a few degrees, but accuracy in the sorting process increases with greater temperature differentials.

The image from the optical camera 155 can be used to specifically identify the location of plastics or other type of material that is not heated by microwave radiation. For example, if the materials to be sorted include wood, rubber, foam, and plastic, the thermal image captured by the thermal imaging camera 150 and the optical image captured by the optical camera 155 can be processed such that the objects identified with in the thermal image can be subtracted from the image from the optical camera 155. The resulting image depicts the locations of plastic objects. The optical camera 155 is not necessary to the system and materials may be sorted based on the thermal image alone.

The computer 160 controls a sorter 170. In this exemplary embodiment, the sorter 170 includes an array of air jets. Compressed air for the air jets is provided by a compressor 175. The computer 160 tracks the location of the objects on the conveyor belt 120 and triggers one or more air jets on the sorter 170. For example, the system 100 is configured to divert plastic into box 140. The computer 160 determines that object 134 is a piece of plastic. When the object 134 reaches the end of the conveyor belt 120 and begins to fall, the computer 160 signals one or more air jets on the sorter 170 to actuate and direct the object 134 into the box 140 rather than fall onto the conveyor belt 125. To further illustrate this process, object 136 represents a piece of foam. As it moved to the end of conveyor belt 120, the computer 160, determining that the object 136 was a piece of foam, did not actuate any air jets. The object 136 fell from conveyor belt 120 to conveyor belt 125, which then carries the object 136 to the box 145, similar to object 137. In comparison, an object 135 represents a piece of plastic that was diverted to the box 140 by the sorter 170.

Other conveyor systems could be used. For example, the conveyor belt 125 could be omitted and the box 145 positioned such that objects fell into the box 145 when they fell from the conveyor belt 120 but were not redirected by the sorter 170. Similarly, wood, foam, and rubber objects may be diverted by the sorter 170 while plastic objects are not acted upon by the sorter 170. Also, one or both of the containers 140, 145 could be omitted and the materials could be conveyed to a subsequent process step.

Figure 2:
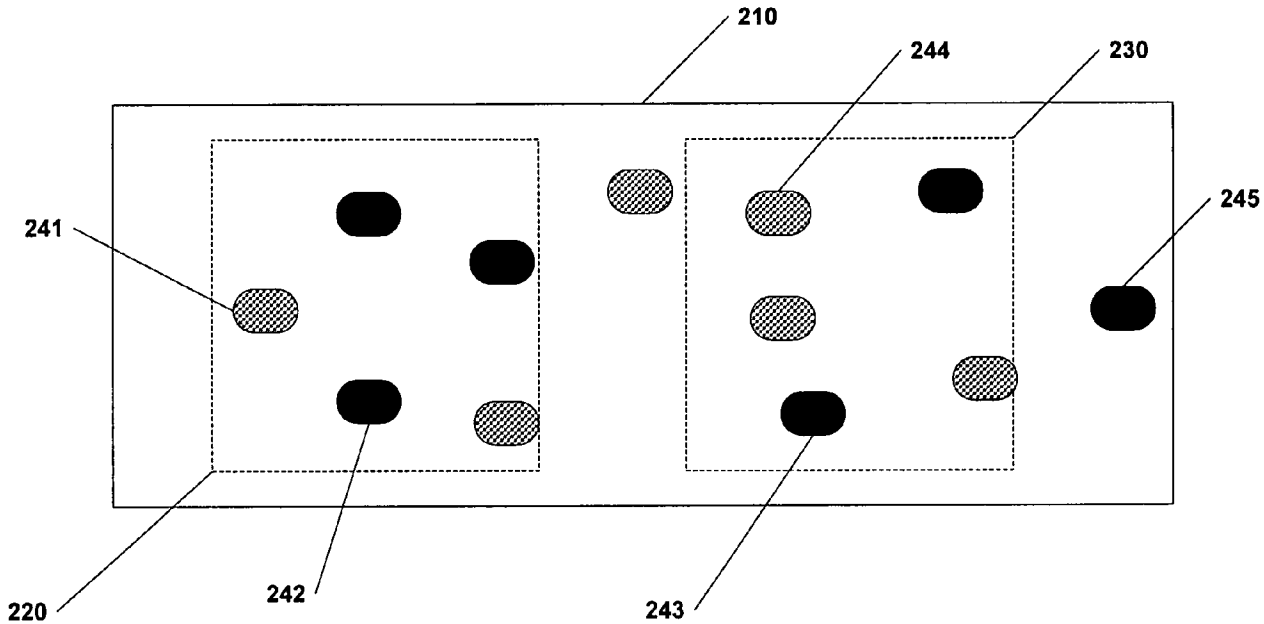
FIG. 2 depicts dissimilar materials on a conveyance system in accordance with an exemplary embodiment of the present invention.

FIG. 2 depicts dissimilar materials on a conveyance system 200 in accordance with an exemplary embodiment of the present invention. Referring to FIGS. 1 and 2, a conveyor belt 210 moves objects, such as shredder residue consisting of wood, plastic, rubber, foam, and metal. The conveyance system 200 illustrates a portion of the overall conveyance system. For example, the system 200 may also include one or more components (not shown) that deliver material to be sorted to the conveyor belt 210 and one or more components (not shown) that remove material after it leaves the conveyor belt 210.

For purposes of this discussion, the objects move from the left side of the page to the right side. As with FIG. 1, for illustration purposes, FIG. 2 depicts the materials to be sorted with two patterns. For example, the object 241 is depicted with a cross-hatch pattern and represents wood, foam, or rubber. Object 242 is depicted with a solid black pattern and represents plastic. These depictions are for illustration purposes and are not meant to indicate that the materials are sorted based on their color or appearance. Similarly, although the objects are depicted as regular shapes, the objects to be sorted typically would have irregular shapes.

A region 220, depicted by a dash-lined box, represents the area on the conveyor belt 210 where objects, such as objects 241, 242, are irradiated with microwave radiation, such as by microwave source 110. As the conveyor belt 210 continues to move, the objects move into a region 230. This region represents the region "seen" by an imaging system, such as thermal imaging camera 150 and optical camera 155. For example, an image captured by the thermal imaging camera 150 would "see" a wood object, such as object 244, as a brighter object than a plastic object, such as object 243. Again, this distinction in the image is because wood is heated by microwave energy to a greater degree than plastic. A thermal image depicts the warmer material as a brighter image.

When exposed to the microwave radiation, wood, rubber, and foam pieces that may be on the conveyor belt absorb the microwave radiation and are heated through dielectric heating. The plastic pieces on the conveyor belt are not heated by the microwaves. The exposure time and microwave energy are both adjustable. The exposure time can be controlled by the speed of the conveyor belt and the area of the conveyor belt that is exposed to microwave radiation. The magnitude of microwave energy that is applied to the mixed pieces will also change the dielectric heating rate of the materials.

As the objects move to the end of the conveyor belt 210, the objects are tracked such that they may be acted upon. For example, in an embodiment that diverts plastic objects with a sorter, such as sorter 170, the object 245 would be acted upon by the sorter 170 as it falls off the end of the conveyor belt 210.

Figure 3:
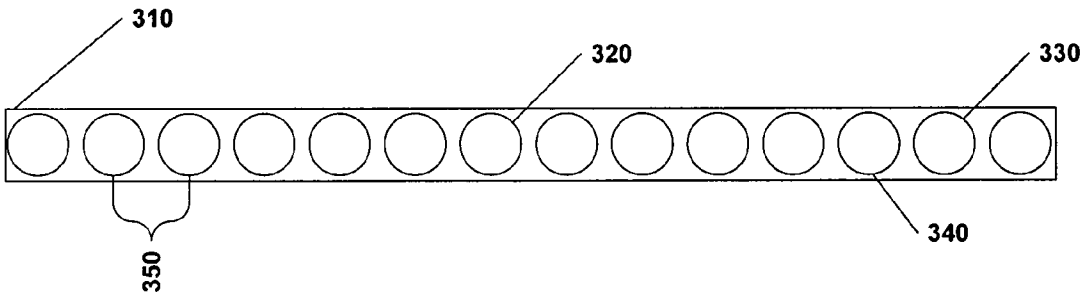
FIG. 3 depicts an air sorter in accordance with an exemplary embodiment of the present invention.

FIG. 3 depicts an air sorter 300 in accordance with an exemplary embodiment of the present invention. Referring to FIGS. 1 and 3, the air sorter 300 includes a housing 310 and multiple air jets, such as air jet 320. In an exemplary embodiment, 64 air jets are included in the air sorter 300, with a pitch (that is, the distance 350) of 9 millimeters. The length of the air sorter 300 would encompass the width of a conveyance system, such as conveyor belt 120. The air sorter 300 delivers compressed air at a sufficient velocity to deflect an object as it reaches the end of the conveyor. For example, an imaging system may detect an object to deflect, such as a piece of plastic. As the object reaches the end of the conveyor, one or more air jets are actuated to deflect the object with a burs of air. For example, a piece of plastic moving along the center of the conveyor belt 120 may be deflected into a container by actuating air jet 320.

In some cases, multiple air jets may be actuated to deflect a given object, based on the size of the object. For example, the sorting system may cause air jets 330 and 340 to be actuated to act on an object that is wide enough to be acted upon by the two jets. As many air jets as necessary to deflect an object may be used. Also, if multiple objects to be deflected reach the end of the conveyor at the same time, multiple air jets could be actuated, with each object aligned with one or more air jets.

Figure 4:
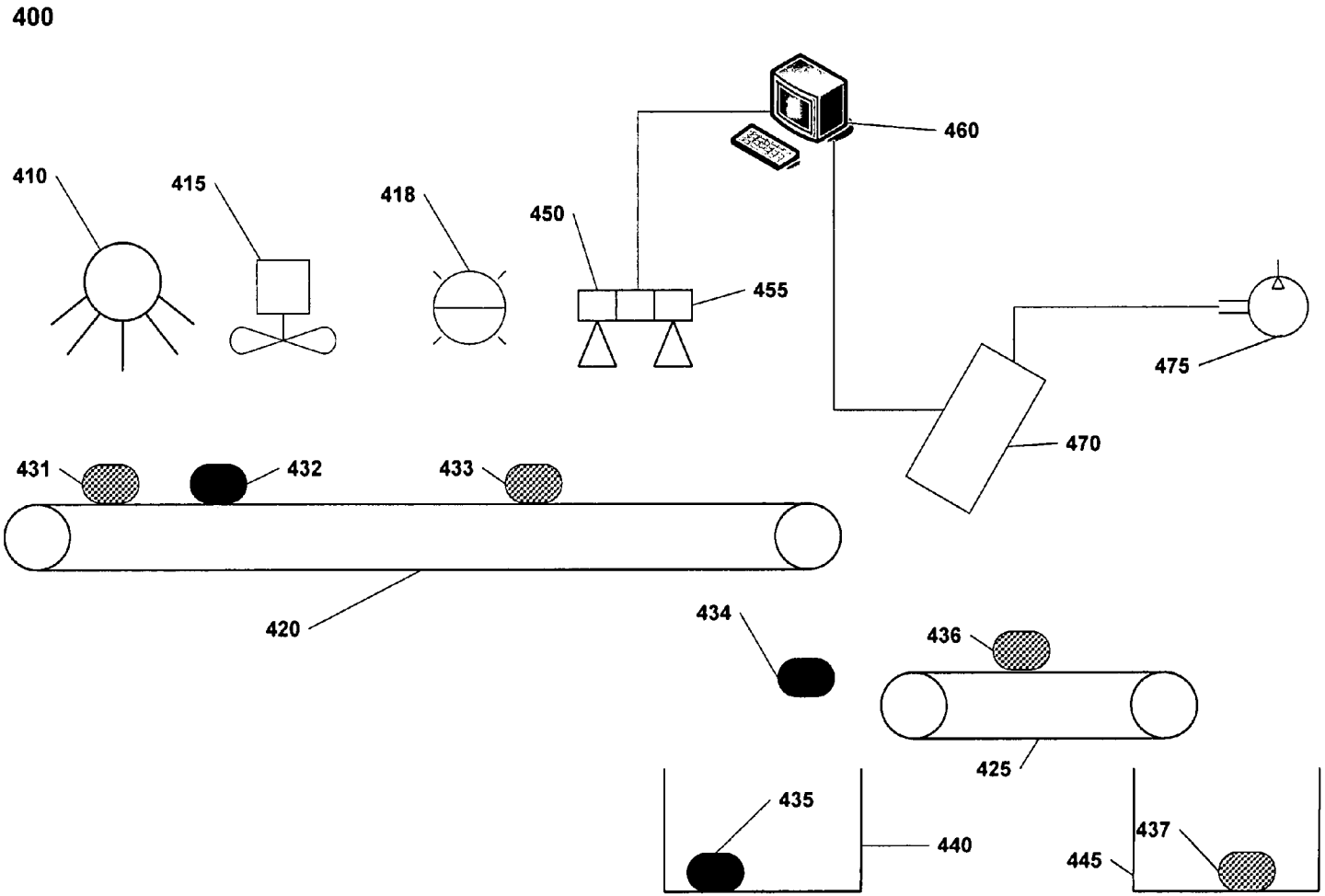
FIG. 4 depicts an ultraviolet radiation sorting system in accordance with an exemplary embodiment of the present invention.

FIG. 4 depicts an ultraviolet radiation sorting system 400 in accordance with an exemplary embodiment of the present invention. Referring to FIG. 4, a sprayer 410 is operable to spray dye and carrier liquid onto objects that move along a conveyer system, including conveyor belt 420. The dye fluoresces when subjected to ultraviolet (UV) light or other light. This commercially-available dye may be in different forms and different colors. Typically, the dye is prepared using water or another carrier liquid that can be sprayed on the objects.

The dye and carrier liquid are absorbed into the pores of an object. As such, the more porous a material, the more likely that the liquid will be absorbed by the object. Wood, rubber, and foam are more porous than plastic and will preferentially absorb the dye and carrier liquid. FIG. 4 depicts the materials to be sorted with two patterns. For example, the object 431 is depicted with a cross-hatch pattern and represents wood, foam, or rubber. Object 432 is depicted with a solid black pattern and represents plastic. These depictions are for illustration purposes and are not meant to indicate that the materials are sorted based on their color or appearance.

As the objects move on the conveyor belt 420, they encounter a dryer 415. The dryer 415 removes excess liquid from the objects. This excess liquid would be dye and carrier liquid that has not been absorbed into pores of the object. For example, as object 433 (a piece of foam) moves under the dryer 415, liquid on the surface of the object 433 is removed, but any liquid in the pores of object 433 remains. The dryer 415 may be a convection dryer, that moves air over the object to evaporate the liquid. This air may be heated. Alternatively, the dryer 415 may be a radiant heat dryer, that evaporates the liquid using radiant heat.

The speed of the conveyor belt 420 is optimized based on the application of the dye and carrier liquid on objects and the removal of excess liquid. In an alternative embodiment, dye may be applied to objects before they are added to the conveyor belt 420, such as by immersing the objects in the dye and carrier liquid. Similarly, in this alternative embodiment, excess liquid may be removed before the objects are added to the conveyor belt 420.

UV light source 418 illuminates objects on the conveyor belt 420, such as object 433. The wavelength of light emitted by the UV light source 418 corresponds to the properties of the dye chosen. That is, different dyes fluoresce when exposed to different wavelengths of light. Indeed, some dyes fluoresce under visible light and a visible light dye could be used, with the light source emitting visible light instead of UV light.

A fluorescent imaging camera 450 detects the fluoresce emitted by objects that retain dye and carrier liquid within their pores. As such, the fluorescent imaging camera 450 can capture images of porous objects, such as wood, rubber, and foam. Plastic or metal objects would not fluoresce. The fluorescent imaging camera 450 would not detect the presence of plastic or metal objects.

An optical camera 455 works in conjunction with the fluorescent imaging camera 450 to capture an image of objects being assessed by the fluorescent imaging camera 450. The image from the optical camera 455 would be similar to the image taken from a normal camera, which is based on capturing visible light. The image from the optical camera 455 can be used to support the sorting process, as described below.

The captured fluorescent image is processed by a computer 460. The computer 460 includes software that can interpret the image captured by the fluorescent imaging camera 450 and distinguish objects based on the image. UV imaging systems detect the fluorescence from the UV dye.

The image from the optical camera 455 can be used to specifically identify the location of plastics or other type of material that does not absorb the dye and carrier liquid. For example, if the materials to be sorted include wood, rubber, foam, and plastic, the image captured by the fluorescent imaging camera 450 and the optical image captured by the optical camera 455 can be processed such that the objects identified with in the fluorescent image can be subtracted from the image from the optical camera 455. The resulting image depicts the locations of plastic or other nonporous objects. The optical camera 455 is not necessary to the system and materials may be sorted based on the image captured by the fluorescent imaging camera 450 alone.

The computer 460 controls a sorter 470. In this exemplary embodiment, the sorter is an array of air jets. Compressed air for the air jets is provided by a compressor 475. The computer 460 tracks the location of the objects on the conveyor belt 420 and triggers one or more air jets on the sorter 470. For example, the system 400 is configured to divert plastic into box 440. The computer 460 determines that object 434 is a piece of plastic. When the object 434 reaches the end of the conveyor belt 420 and begins to fall, the computer 460 signals one or more air jets on the sorter 470 to actuate and direct the object 434 into the box 440 rather than fall onto the conveyor belt 425. To further illustrate this process, object 436 represents a piece of foam. As it moved to the end of conveyor belt 420, the computer 460, determining that the object 436 was a piece of foam, did not actuate any air jets. The object 436 fell from conveyor belt 420 to conveyor belt 425, which then carries the object 436 to the box 445, similar to object 437. In comparison, an object 435 represents a piece of plastic that was diverted to the box 440 by the sorter 470.

Other conveyor systems could be used. For example, the conveyor belt 425 could be omitted and the box 445 positioned such that objects fell into the box 445 when they fell from the conveyor belt 420 but were not redirected by the sorter 470. Similarly, wood, foam, and rubber objects may be diverted by the sorter 470 while plastic objects are not acted upon by the sorter 470. Also, one or both of the containers 440, 445 could be omitted and the materials could be conveyed to a subsequent process step.

Figure 5:
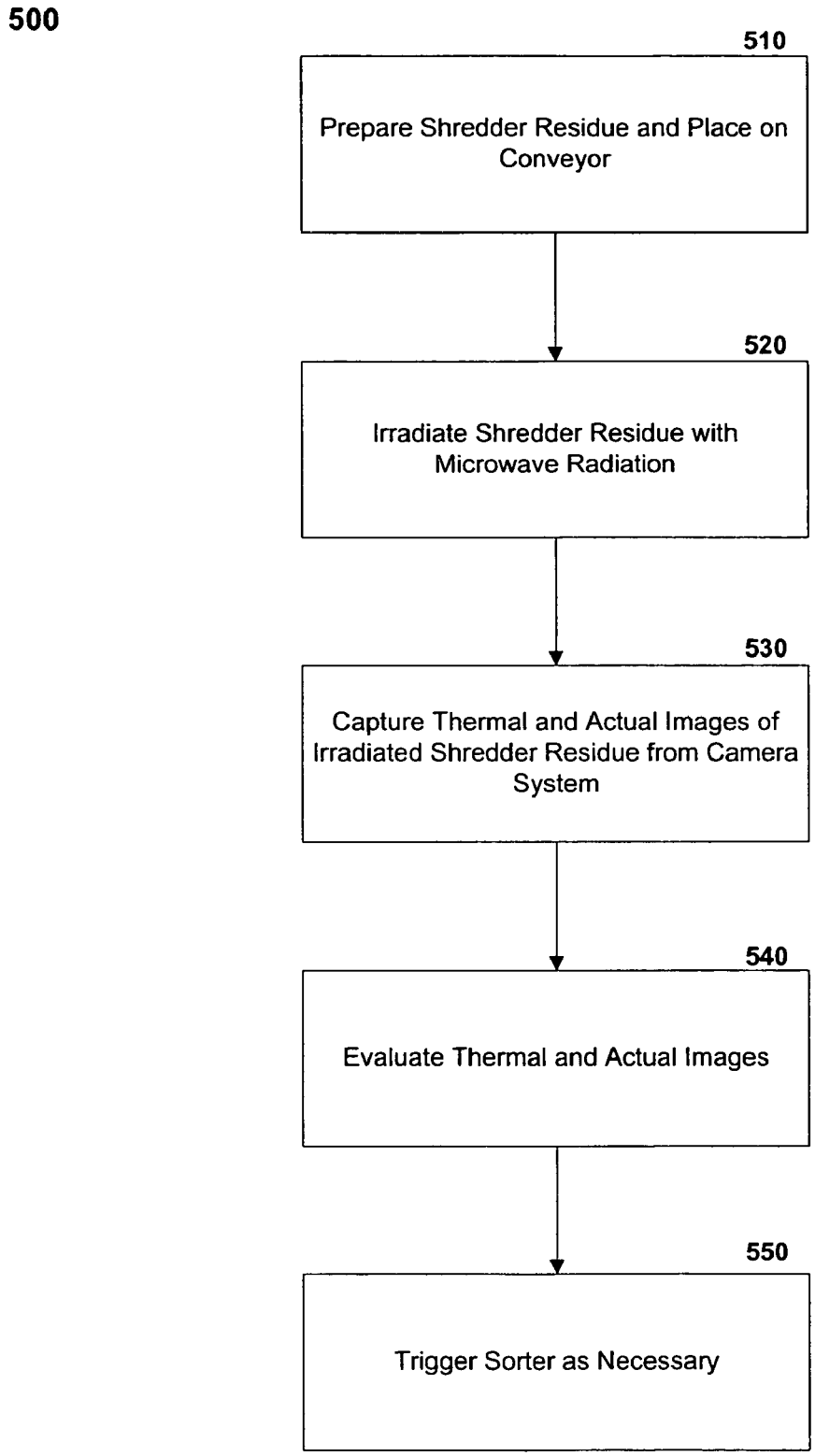
FIG. 5 depicts a process flow for separating dissimilar materials using microwaves in accordance with an exemplary embodiment of the present invention.

FIG. 5 depicts a process flow 500 for separating dissimilar materials using microwaves in accordance with an exemplary embodiment of the present invention. Referring to FIGS. 1 and 5, at step 510 material, such as shredder residue, is prepared and placed on a conveyor system, such as conveyor belt 120. Of course, the material to be sorted may be something other than shredder residue. In preparing the material, it may be sized to a specific size range. Also, the material may be pre-processed, that is, subjected to other operations that separate certain materials, such as metals, from the waste stream. An additional pre-processing step may include stabilizing the moisture content of the material before it is sent to the conveyance system, as discussed above in connection with FIG. 1. In this pre-processing step, the material is subjected to a humidifier or mister, to expose the material to moisture. Then, the material is subjected to a dryer, which removes the moisture from the surface of the non-porous materials, such as plastic, but not from the porous materials, such as wood. Again, although this pre-processing step may have some benefit to the overall process by increasing the dielectric heating of some materials, this step is not necessary.

At step 520, the microwave source 110 irradiates the shredder residue with microwave radiation. Alternatively, radio wave radiation may be used. At step 530, the thermal imaging camera 150 and optical camera 155 capture a thermal image and actual image of irradiated material as it moves on conveyor belt 120, respectfully.

At step 540, the computer 160 evaluates the thermal image and actual image. This evaluation identifies the location of materials on the conveyor belt 120 that were heated as a result of the irradiation step, step 520. This evaluation may also identify the location of materials on the conveyor belt 120 that were not heated. This latter evaluation may be accomplished by subtracting the location information determined from the thermal image from the location information in the actual image. The resulting objects would be those objects unaffected by the microwave heating. As discussed above, the optical camera 155 could be omitted from the process and the actual image not captured. In that case, the evaluation step 540 would identify the location on the conveyor belt 120 of objects that were heated by the microwave radiation only.

At step 550, the computer 160 would trigger the sorter 170, as necessary, to divert specific objects into a container or secondary conveyance system. For example, the computer 160 may cause air jets of the sorter 170 to actuate, which diverts objects, such as plastic or wood objects, into a container or secondary conveyance system. This secondary conveyance system may move the objects to a subsequent process.

Figure 6:
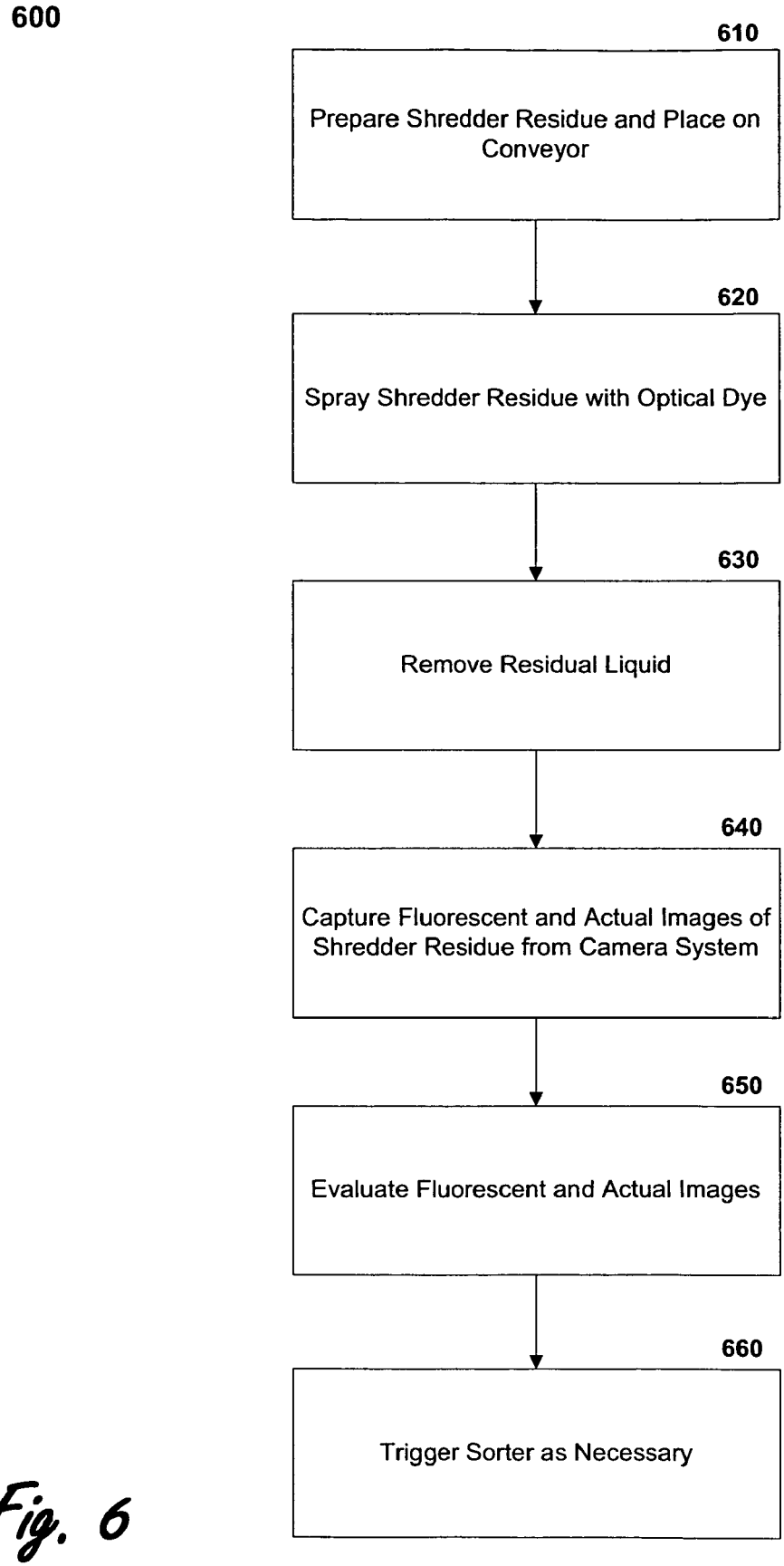
FIG. 6 depicts a process flow for separating dissimilar materials using fluorescent dyes in accordance with an exemplary embodiment of the present invention.

FIG. 6 depicts a process flow 600 for separating dissimilar materials using fluorescent dyes in accordance with an exemplary embodiment of the present invention. Referring to FIGS. 4 and 6, at step 610 material, such as shredder residue, is prepared and placed on a conveyor system, such as conveyor belt 420. Of course, the material to be sorted may be something other than shredder residue. In preparing the material, it may be sized to a specific size range. Also, the material may be pre-processed, that is, subjected to other operations that separate certain materials, such as metals, from the waste stream.

At step 620, the sprayer 410 sprays the shredder residue objects with optical dye. This dye may fluoresce under UV or visible light. At step 630, the dryer 425 removes residual liquid, leaving dye and carrier liquid in the pores of the sprayed objects. Alternatively, steps 620 and 630 may be performed prior to the material being placed on the conveyor belt 420. For example, the shredder residue may be immersed in the dye and carrier liquid, then the excess liquid removed before being transferred to conveyor belt 420.

At step 640, the fluorescent imaging camera 450 and optical camera 455 capture a fluorescence image and actual image of objects as they move on conveyor belt 420, respectfully. As part of this step, the objects are illuminated with light. If a UV fluorescent dye is used, then the objects are illuminated with UV light. Similarly, if a visible light fluorescent dye is used, then the objects are illuminated with visible light. The fluorescent imaging camera 450 captures the fluorescence from the dye that is absorbed in the pores of porous objects.

At step 650, the computer 460 evaluates the fluorescent image and actual image. This evaluation identifies the location of materials on the conveyor belt 420 that absorbed dye as a result of the spraying step, step 620. This evaluation may also identify the location of materials on the conveyor belt 420 that do not fluoresce. This latter evaluation may be accomplished by subtracting the location information determined from the fluorescent image from the location information in the actual image. The resulting objects would be those objects that did not absorb the dye and carrier liquid. As discussed above, the optical camera 455 could be omitted from the process and the actual image not captured. In that case, the evaluation step 650 would identify the location on the conveyor belt 420 of objects that fluoresce.

At step 660, the computer 460 would trigger the sorter 470, as necessary, to divert specific objects into a container or secondary conveyance system. For example, the computer 460 may cause air jets of the sorter 470 to actuate, which diverts objects, such as plastic or wood objects, into a container or secondary conveyance system. This secondary conveyance system may move the objects to a subsequent process.

One of ordinary skill in the art would appreciate that the present invention provides systems and methods for sorting dissimilar materials, such as sorting plastics from wood, foam, or rubber. These systems and methods employ either dielectric heating or fluorescent dye absorption characteristics of materials to distinguish the materials. The systems and methods may employ differential dielectric heating and thermal imaging to sort wood, rubber, and foam, from plastic, metals, and other materials that do not undergo dielectric heating. Similarly, systems and methods may employ the greater liquid absorption properties of wood, rubber, and foam as compared to plastic. The dissimilar materials are subjected to fluorescent dye and carrier liquid, that is differentially absorbed by objects. Fluorescent imaging can be used to distinguish the materials. In either case, a computer-controlled system can be used to sort material types based on an evaluation of the thermal or fluorescent image.

What is claimed is:

1. A system for sorting a plurality of objects within a waste stream comprising:

the waste stream comprising porous and non-porous objects, wherein the non-porous objects comprise plastic objects and the porous objects comprise at least one of wood and rubber;

an electromagnetic radiation source;

a water source for adding water to the plurality of objects, wherein at least some of the porous objects absorb some of the water;

a dryer for removing water from the surface of the non-porous objects;

a thermal image captured by a thermal imaging camera, wherein the thermal image comprises differentiated images based in part on water absorbed by porous objects;

a computer, logically connected to the thermal imaging camera and operable to evaluate the thermal image captured by the thermal imaging camera; and a sorter, logically connected to the computer and operable to divert one or more of the plurality of objects.

2. The system of claim 1, further comprising a conveyor, operable to move the plurality of objects from the electromagnetic radiation source to the sorter.

3. The system of claim 1 further comprising an optical camera, operable to capture an actual image of the plurality of objects and further operable to communicate that image to the computer.

4. The system of claim 3 wherein the computer is further operable to process both the thermal image and the actual image to identify objects that are identifiable on the actual image but are not identifiable on the thermal image.

5. The system of claim 1 wherein the objects comprise plastic material.

6. The system of claim 1 wherein the electromagnetic radiation source comprises a microwave source.

7. The system of claim 1 wherein the sorter comprises an air sorter, operable to respond to the computer to actuate one or more air jets to divert one or more of the plurality of objects.

8. A method for sorting a plurality of objects comprising porous and non-porous objects, the method comprising the steps of:

a) adding water to the plurality of objects, wherein the porous objects comprise at least one of wood and rubber and absorb at least some of the added water;

b) removing water from the surface of the non-porous objects;

c) placing the plurality of objects on a conveyor;

d) irradiating the plurality of objects with electromagnetic radiation, wherein a portion of the plurality of objects increase in temperature in response to the irradiation;

e) capturing a thermal image of the irradiated plurality of objects;

f) evaluating the thermal image; and g) triggering a sorter in response to the evaluation to divert one or more of the plurality of objects, wherein the evaluation identifies porous objects based in part on the water absorbed by the porous objects.

9. The method of claim 8 further comprising the step of capturing an actual image of the plurality of objects when the thermal image is captured, wherein step e) includes evaluating both the thermal image and the actual image.

10. The method of claim 8 wherein the electromagnetic radiation comprises microwave radiation.

11. The method of claim 8 wherein the sorter comprises an air sorter and the step e) comprises actuating one or more air jets of the air sorter to divert one or more of the plurality of objects.

* * * * *